US011305298B2

(12) United States Patent
Stoddart

(10) Patent No.: US 11,305,298 B2
(45) Date of Patent: Apr. 19, 2022

(54) DISCHARGE MODIFIER FOR PRESSURIZED VESSELS

(71) Applicant: Behr Process Corporation, Santa Ana, CA (US)

(72) Inventor: Darren Wade Stoddart, Huntington Beach, CA (US)

(73) Assignee: BEHR PROCESS CORPORATION, Santa Ana, CA (US)

( * ) Notice: Subject to any disclaimer, the term of this patent is extended or adjusted under 35 U.S.C. 154(b) by 0 days.

(21) Appl. No.: 17/043,090

(22) PCT Filed: Mar. 29, 2019

(86) PCT No.: PCT/US2019/024800
§ 371 (c)(1),
(2) Date: Sep. 29, 2020

(87) PCT Pub. No.: WO2019/209459
PCT Pub. Date: Oct. 31, 2019

(65) Prior Publication Data

US 2021/0016300 A1 Jan. 21, 2021

Related U.S. Application Data

(60) Provisional application No. 62/661,837, filed on Apr. 24, 2018.

(51) Int. Cl.

| | |
|---|---|
| ***B05B 1/16*** | (2006.01) |
| ***B65D 83/20*** | (2006.01) |
| ***B65D 83/28*** | (2006.01) |

(52) U.S. Cl.
CPC ..... *B05B 1/1645* (2013.01); *B65D 83/205* (2013.01); *B65D 83/28* (2013.01)

(58) Field of Classification Search
CPC ... B05B 1/1645; B05B 1/1636; B65D 83/205; B65D 83/28
See application file for complete search history.

(56) References Cited

U.S. PATENT DOCUMENTS

| | | | | |
|---|---|---|---|---|
| 2,887,273 A | | 5/1959 | Anderson et al. | |
| 2,997,243 A | | 8/1961 | Kolb | |
| 3,083,872 A | * | 4/1963 | Meshberg | B05B 1/1645 239/73 |
| 3,180,536 A | | 4/1965 | Meshberg | |

(Continued)

FOREIGN PATENT DOCUMENTS

DE 102005055979 A1 10/2006

*Primary Examiner* — Donnell A Long
(74) *Attorney, Agent, or Firm* — Reising Ethington P.C.

(57) ABSTRACT

A discharge modifier for a pressurized vessel. A shroud includes a base wall, a circumferentially extending skirt extending away from the base wall, and an outlet in the skirt. A manifold includes a hub, including an axial lower end, an axially upper end, a radially outer surface, an inlet at the lower end, a main passage extending between the lower and upper ends, and a plurality of branch passages in fluid communication with, and extending transversely outwardly from, the main passage. The manifold also includes a plurality of barrels extending radially outwardly with respect to the manifold hub, and including a plurality of barrel passages in fluid communication with the plurality of branch passages of the manifold hub.

19 Claims, 5 Drawing Sheets

(56) References Cited

U.S. PATENT DOCUMENTS

| | | | | |
|---|---|---|---|---|
| 3,206,082 | A | 9/1965 | Green | |
| 3,342,382 | A | 9/1967 | Huling | |
| 3,653,558 | A | 4/1972 | Shay | |
| 3,703,994 | A | 11/1972 | Nigro | |
| 3,711,030 | A | 1/1973 | Jones | |
| 3,795,366 | A | 3/1974 | McGhie et al. | |
| 3,863,816 | A | 4/1975 | Focht | |
| 3,891,128 | A | 6/1975 | Smrt | |
| 4,257,560 | A | 3/1981 | Diamond | |
| 5,337,926 | A | 8/1994 | Drobish et al. | |
| 5,385,303 | A | 1/1995 | Gosselin et al. | |
| 5,971,230 | A | 10/1999 | Tanaka | |
| 6,000,583 | A | 12/1999 | Stern et al. | |
| 6,027,042 | A | 2/2000 | Smith | |
| 7,278,590 | B1 | 10/2007 | Greer, Jr. et al. | |
| 8,333,304 | B1 | 12/2012 | Haage | |
| 8,840,045 | B2 | 9/2014 | Thurin et al. | |
| 9,187,236 | B2 | 11/2015 | Greer, Jr. et al. | |
| 2005/0121474 | A1* | 6/2005 | Lasserre ..... | B65D 83/205 222/402.1 |
| 2011/0017781 | A1 | 1/2011 | Nelson et al. | |
| 2015/0072076 | A1 | 3/2015 | Greer, Jr. et al. | |
| 2016/0303586 | A1* | 10/2016 | Lo ..... | B05B 3/0422 |
| 2016/0325916 | A1 | 11/2016 | Jasper et al. | |
| 2017/0216852 | A1 | 8/2017 | Gopalan et al. | |

* cited by examiner

DISCHARGE MODIFIER FOR PRESSURIZED VESSELS

TECHNICAL FIELD

This disclosure relates generally to fluid spraying and, more particularly, to fluid spraying apparatuses including discharge modifiers.

BACKGROUND

A typical pressurized sprayer usually includes a pressurized vessel to hold fluid under pressure and provide a valved outlet for the fluid, and a discharge modifier in fluid communication with the valved outlet to modify output from the pressurized vessel. The pressurized vessel usually includes a container having a closed bottom, and sidewalls extending upwardly from the closed bottom and terminating in an open top. The pressurized vessel also usually includes a closure coupled to the open top of the container and carrying the valved outlet, which includes an internal valve assembly having a valve stem extending out of the pressurized vessel. The discharge modifier usually includes a body having a through passage including a single inlet coupled to the valve stem and a single outlet in fluid communication with the inlet to produce a desired spray pattern.

SUMMARY

An illustrative embodiment of a discharge modifier for a pressurized vessel includes a shroud including a base wall, a circumferentially extending skirt extending away from the base wall, and an outlet in the skirt. The discharge modifier also includes a manifold including a hub having an axially lower end, an axially upper end, a radially outer surface, an inlet at the lower end, a main passage extending between the lower and upper ends, and a plurality of branch passages in fluid communication with, and extending transversely outwardly from, the main passage. The manifold also includes a plurality of barrels extending radially outwardly with respect to the manifold hub, and including a plurality of barrel passages in fluid communication with the plurality of branch passages of the manifold hub.

DETAILED DESCRIPTION

Figure 1:
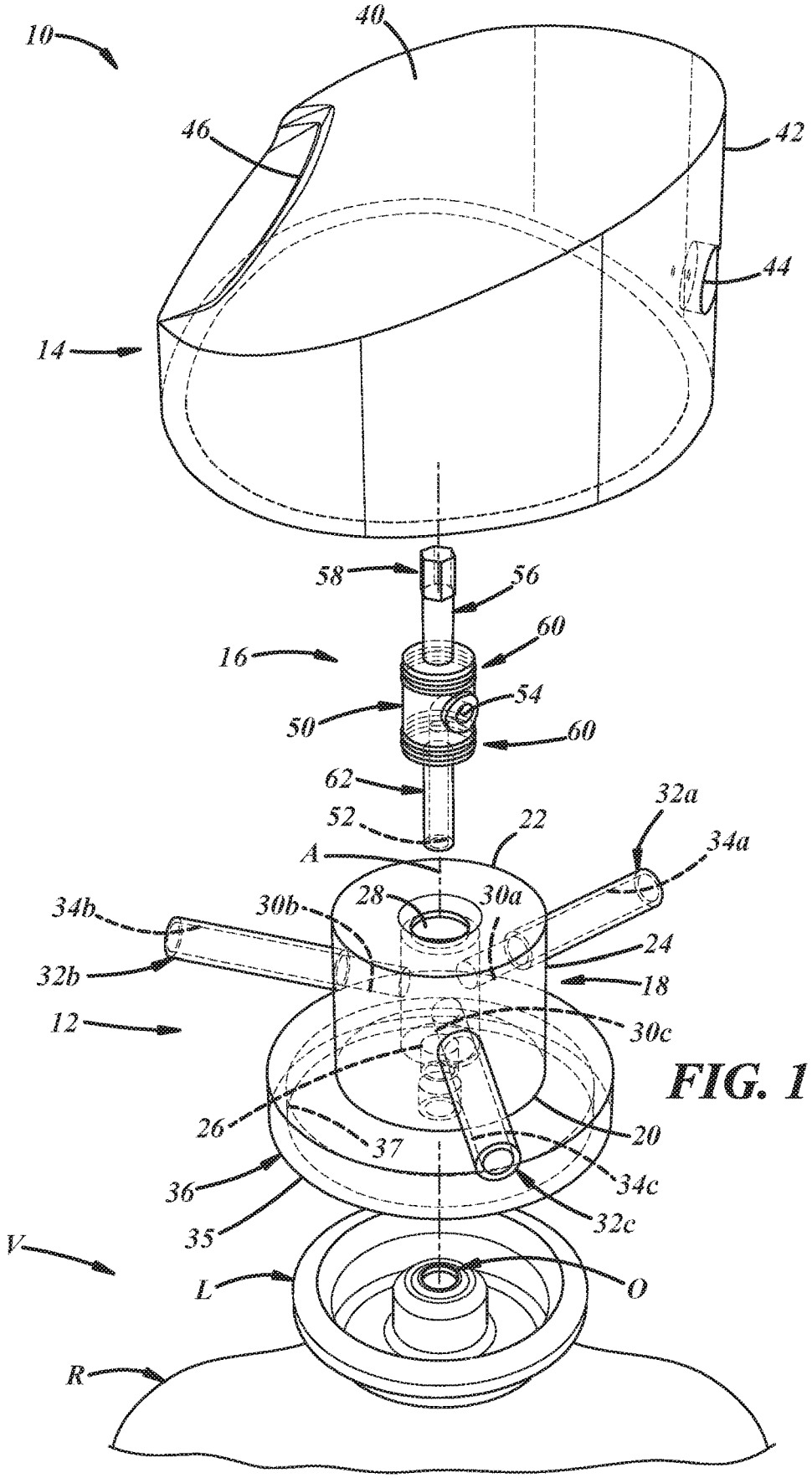
FIG. 1 is a fragmentary, exploded, upper, side perspective view according to an illustrative embodiment of a pressurized sprayer including a pressurized vessel and a discharge modifier coupled to the vessel.
Figure 2:
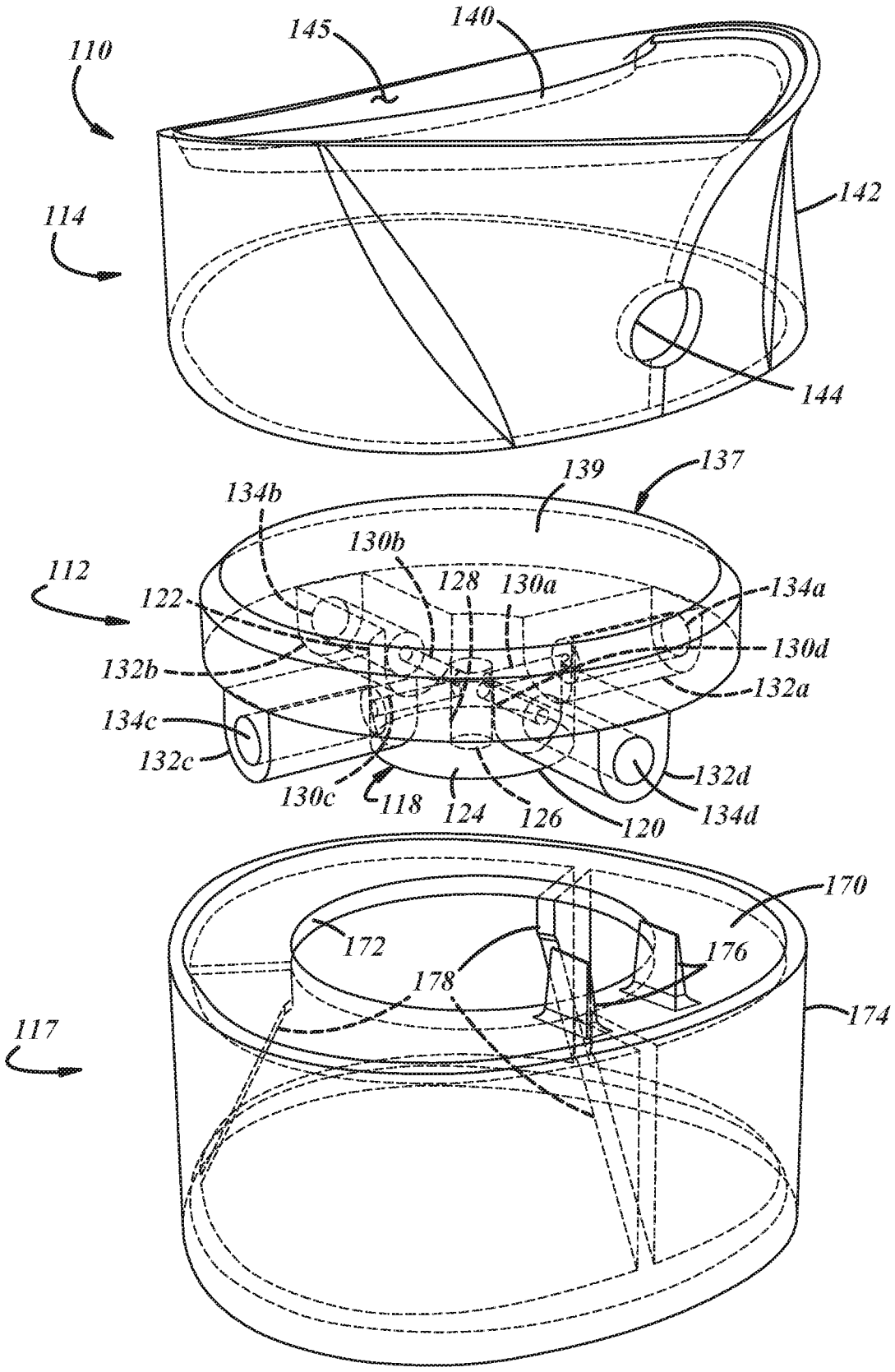
FIG. 2 is an exploded, upper, frontal perspective view according to an illustrative embodiment of another discharge modifier.
Figure 3:
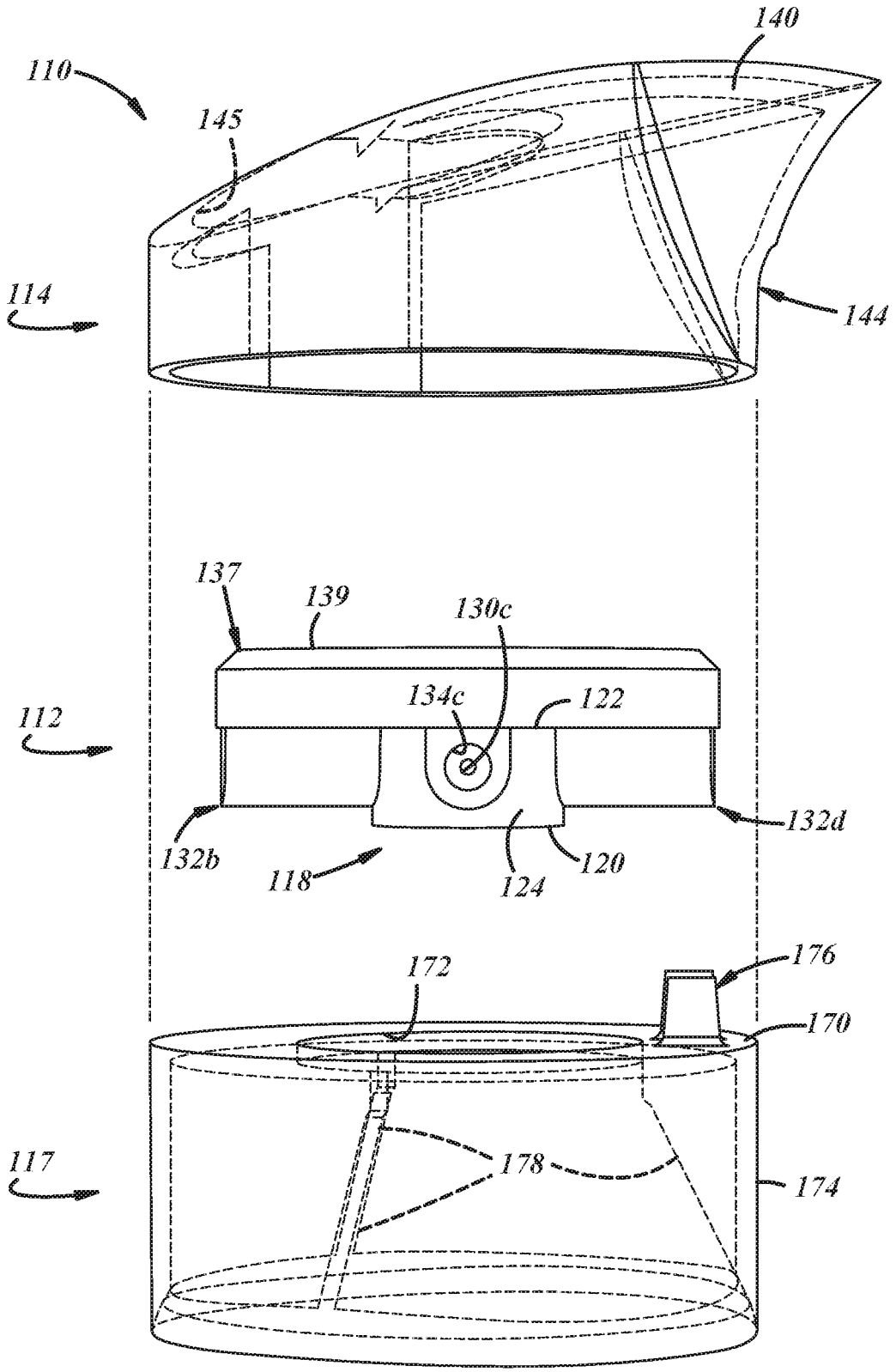
FIG. 3 is an exploded, side elevational view according to the discharge modifier of FIG. 2.
Figure 4:
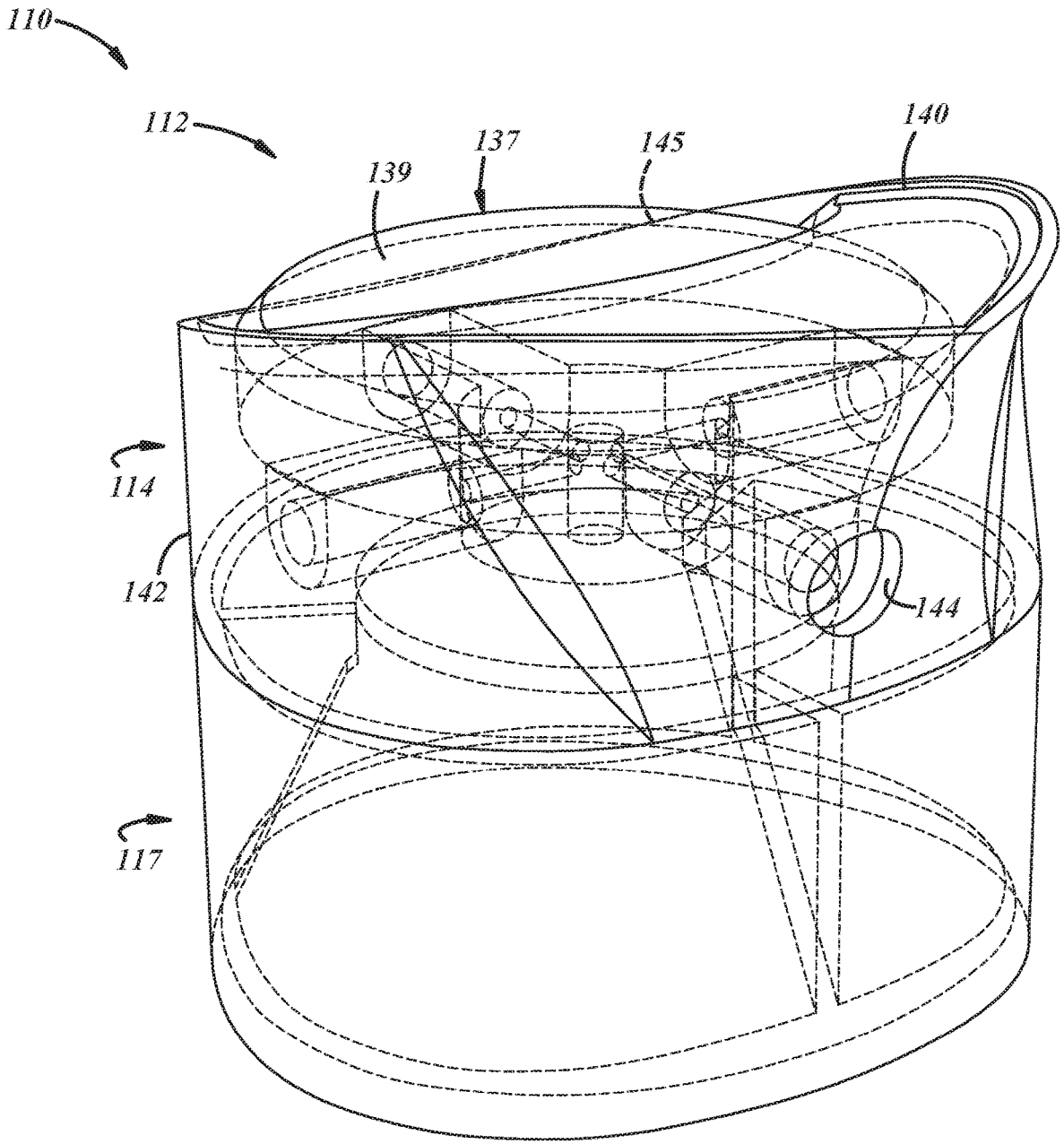
FIG. 4 is an upper, frontal perspective view of the discharge modifier of FIG. 2, illustrated in an assembled state.
Figure 5:
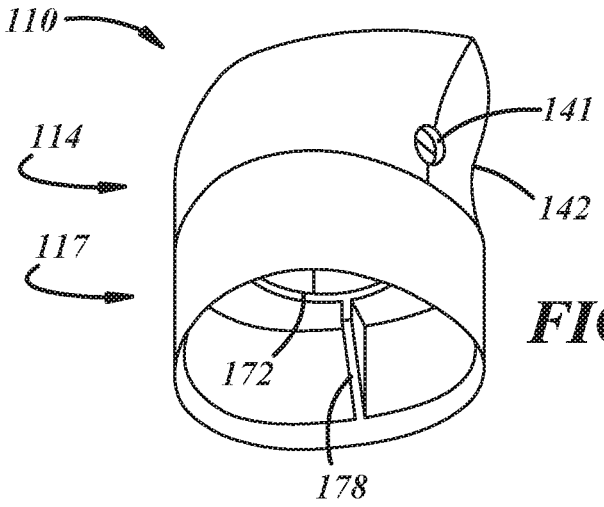
FIG. 5 is a reduced, lower, frontal perspective view of the discharge modifier of FIG. 2, illustrated in an assembled state.
Figure 6:
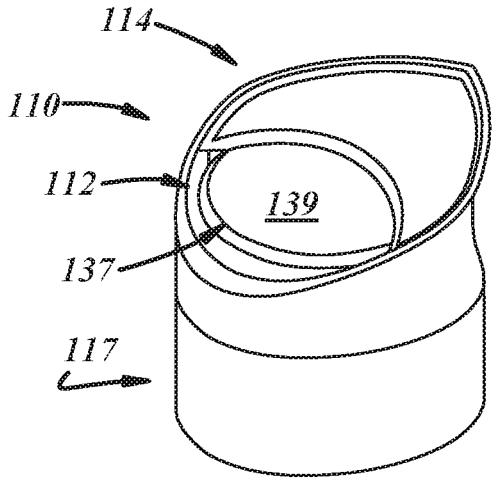
FIG. 6 is a reduced, upper, rear perspective view of the discharge modifier of FIG. 2, illustrated in an assembled state.
Figure 7:
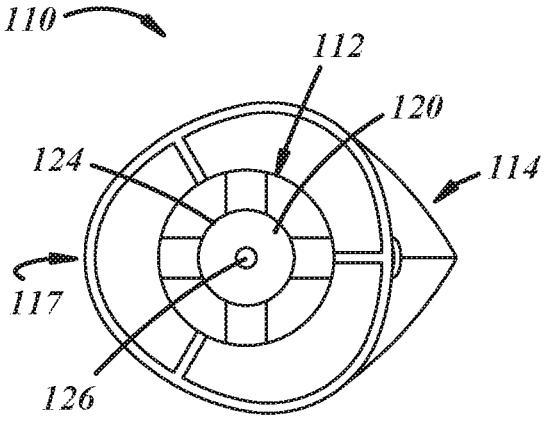
FIG. 7 is a reduced, bottom view of the discharge modifier of FIG. 2, illustrated in an assembled state.
Figure 8:
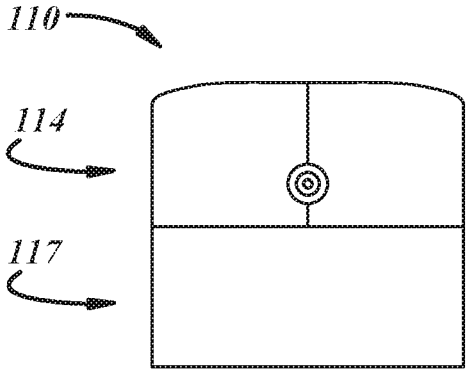
FIG. 8 is a reduced front view of the discharge modifier of FIG. 2, illustrated in an assembled state.
Figure 9:
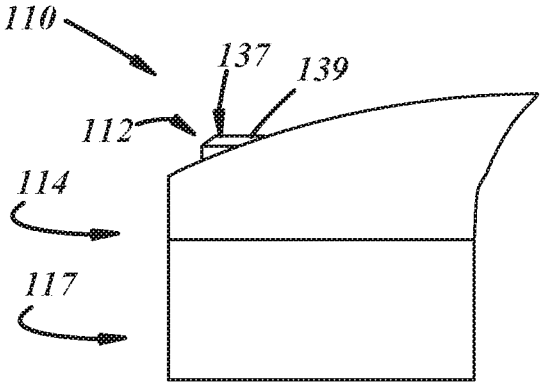
FIG. 9 is a reduced, side elevational view of the discharge modifier of FIG. 2, illustrated in an assembled state.

FIG. 1 shows an illustrative embodiment of a discharge modifier 10 for a pressurized vessel V. The discharge modifier 10 is selectively arrangeable to provide different discharge characteristics according to one or more spray parameters, like spray pattern shape or size, spray flow, or the like.

The pressurized vessel V is configured for holding a pressurized fluid, including, but not limited to, paints, adhesives, sealants, lubricants, hair spray or other personal care products, household deodorants or disinfectants, cooking spray, oven cleaner, or any other suitable fluid. In the illustrated embodiment, the pressurized vessel includes a container R and a closure L coupled to the container R and that may carry a valved outlet O and also may carry an internal valve assembly (not shown) having a valve stem (not shown) extending out of the pressurized vessel V. In other embodiments, the closure L may be coupled directly to the container R or may be indirectly coupled to the container R via a dome or other intermediate component. Pressurized vessels and valve assemblies are well known in the art, and any pressurized vessels and valve assemblies suitable for use with the presently disclosed discharge modifier 10 may be used.

The discharge modifier 10 generally includes a manifold 12 to provide multiple fluid paths for fluid flowing from the pressurized vessel V, and a shroud 14 carried over the manifold 12 to provide an ornamental or decorative cover and actuator member. The discharge modifier 10 also generally may include a distributor 16 to distribute fluid to the manifold fluid paths.

The manifold 12 includes a hub 18 having an axially lower end 20, an axially upper end 22, and a radially outer surface 24. The hub 18 also includes an inlet 26 at the lower end 20, a main passage 28 extending along an axis A between the lower and upper ends 20, 22, and a plurality of branch passages 30*a*, 30*b*, 30*c* in fluid communication with, and extending transversely outwardly from, the main passage 28. As used herein, the terminology "transversely" may include perpendicularly or radially disposed, as exemplified in FIG. 1, or otherwise obliquely disposed at any suitable non-zero angle with respect to the axis A. In this embodiment, the main passage 28 is an axially extending through passage.

The manifold 12 also includes a plurality of barrels 32*a*, 32*b*, 32*c* extending transversely outwardly with respect to the manifold hub 18, and being of cylindrical shape and including a plurality of barrel passages 34*a*, 34*b*, 34*c* in fluid communication with the plurality of branch passages 30*a*, 30*b*, 30*c* of the manifold hub 18. The barrels 32*a*, 32*b*, 32*c* may extend integrally from the hub 18 such that the hub and barrel portion of the manifold 12 is unitary, or the barrels may be components separate from the hub 18 that may be fastened, adhered, or otherwise coupled thereto in any suitable manner. The branch passages 30*a*, 30*b*, 30*c*, and/or barrels 32*a*, 32*b*, 32*c* may be of differing size and/or shape, and/or may carry orifice inserts (not shown) of differing size and/or shape to produce selectively arrangeable spray characteristics.

The manifold 12 further may include an enlarged flange 36 that may be coupled to the hub 18 at the lower end 20 of the hub 18. The flange 36 may extend integrally from the hub 18 such that the hub and flange portion of the manifold 12 is unitary, or the flange may be a component separate from the hub 18 that may be fastened, adhered, or otherwise coupled thereto in any suitable manner. In any case, the flange 36 includes an outer diameter 35 larger than that of the closure L and an inner diameter 37 that may be smaller than the outer diameter of the closure L such that the flange 36 may be press-fit or interference fit to the vessel V, for instance, to the closure L. Although not shown, the flange inner diameter 37 may include one or more snap-fit features, for instance, projections, ribs, grooves, or the like to cooperate with the closure outer diameter. Likewise, although not shown, the closure outer diameter may include such snap-fit features instead of, or in addition to, those of the flange 36. Additionally, either the flange 36 or the closure L, or both, may include one or more circumferential orientation features, for instance, projection and dimple, tab and groove, or other cooperating detest features or the like. Accordingly, the manifold 12 may be axially retained to the vessel V and/or may be circumferentially fixed against rotation with respect to the vessel V.

The shroud 14 includes a base wall 40, a circumferentially extending skirt 42 extending away from the base wall 40, and an outlet 44 in the skirt 42. The base wall 40 may be entirely closed, as illustrated, or may have one or more openings (not shown) therethrough. A rear portion of the base wall 40 may include a depression 46 that is located diametrically opposite from the outlet 44. The outlet 44 may include a fully circumferential aperture, as illustrated, or a relief open to a bottom of the skirt 42, or the like.

The distributor 16 is rotatably carried in the main passage 28 of the hub 18, and includes a sealing barrel 50, an inlet port 52, an outlet port 54 in communication with the inlet port 52 and extending transversely out of the sealing barrel 50, and an actuator stem 56 extending away from the sealing barrel 50 and coupled to the shroud 14. The actuator stem 56 is preferably coupled to the shroud 14 in a manner that limits or prevents relative circumferential rotation therebetween. As just one of many examples, the actuator stem 56 may be coupled to the shroud 14, for example, via a central internal hub and socket that may be integral with an inside surface of the base wall 40 of the shroud 14. The actuator stem 56 may include a non-circular coupling 58, for instance, a hex coupling as illustrated, or a keyed coupling, flattened coupling, or the like. Likewise, the corresponding socket (not shown) of the shroud 14 may have geometry corresponding to the stem coupling 58. On either axial side of the outlet port 54, the sealing barrel 50 may carry seals 60, which may include O-rings separate from the barrel 50, integral elastomeric rings insert-molded or co-molded to the barrel 50, or any other suitable seals. The distributor 16 also may include a hollow stem 62 that may be a separate component or an integral portion of the distributor 16 for direct actuation of a valve assembly (not shown) of the pressurized vessel V, or for indirect actuation of the valve assembly via a valve stem (not shown) of the valve assembly. In other embodiments, the distributor 16 may omit the hollow stem 62 such that the distributor 16 may be configured for cooperation with the valve stem of the pressurized vessel V.

In assembly, the actuator stem 56 of the distributor 16 may be coupled to the shroud 14 so that the outlet port 54 of the distributor 16 is circumferentially aligned with the outlet 44 of the shroud 14, and the distributor 16 may be inserted into the main passage 28 of the manifold hub 18 such that the outlet port 54 of the distributor 16 is circumferentially aligned with a first one of the plurality of branch passages 30*a*, 30*b*, 30*c*. In one embodiment, the distributor 16 may be inserted into the main passage 28 from below such that an internal shoulder of the manifold hub 18 axially retains the sealing barrel 50 of the distributor 16 such that the distributor 16 would be axially trapped between the manifold 12 and the vessel V. Accordingly, the resulting shroud/distributor/hub sub-assembly may be coupled to the pressurized vessel V, in any suitable manner. Any other suitable order of assembly may be carried out.

In use, a user grasps the pressurized vessel V with the user's hand and depresses the base wall 40 of the shroud 14 with one or more fingers of the user's hand to discharge fluid under pressure out of the pressurized vessel V, through the main passage 28 of the manifold hub 18, through the distributor 16, through the first one of the plurality of branch passages 30*a*, 30*b*, 30*c*, and through the outlet 44 of the shroud 14, out of the discharge modifier 10. To selectively arrange the discharge modifier 10 from a first arrangement to a second arrangement, the discharge modifier 10 need not be disassembled or removed from the pressurized vessel V. Rather, the user may grasp the pressurized vessel V with one hand and may grasp and rotate the shroud 14 with the other hand to circumferentially align the distributor outlet port 54 with a second one of the plurality of branch passages 30*a*, 30*b*, 30*c*. Accordingly, the discharge modifier 10 is selectively arrangeable by rotating the shroud 14 thereof. Any suitable circumferential indexing indicia and/or feature(s) may be carried on one or both of the shroud 14 or the vessel V to facilitate use of the different fluid paths. Likewise, one of more circumferential detent features may be carried by the manifold 12, shroud 14, and/or distributor 16 to circumferentially align the outlet port 54 of the distributor 16 with one of the branch passages and also may provide tactile feedback to the user that the discharge modifier 10 is properly aligned and ready to use.

FIGS. 2-9 show another illustrative embodiment of a discharge modifier 110. This embodiment is similar in many respects to the embodiment of FIG. 1 and like numerals between the embodiments generally designate like or corresponding elements throughout the several views of the drawing figures. Accordingly, the descriptions of the embodiments are hereby incorporated into one another, and description of subject matter common to the embodiments generally may not be repeated.

The discharge modifier 110 generally includes a manifold 112 that provides multiple fluid paths, and a shroud 114 carried over the manifold 112 to provide an ornamental or decorative cover and a pointer for desired spray directionality. The discharge modifier 110 also may include a fitment 117 to facilitate circumferential orientation of the manifold 112 and/or mounting of the manifold 112 with respect to a pressurized vessel (not shown).

The manifold 112 includes a hub 118 having an axially lower end 120, an axially upper end 122, and a radially outer surface 124. The hub 118 also includes an inlet 126 at the lower end 120, a main passage 128 extending between the lower and upper ends 120, 122, and a plurality of branch passages 130*a*, 130*b*, 130*c*, 130*d* in fluid communication with, and extending transversely outwardly from, the main passage 128. In this embodiment, the main passage 128 is blind, or dead-headed at or near the upper end 122 of the hub 118. The manifold 112 also includes a plurality of barrels 132*a*, 132*b*, 132*c*, 132*d* extending radially outwardly with respect to the manifold hub 118, and being of semi-cylindrical shape, and including a plurality of barrel passages 134*a*, 134*b*, 134*c*, 134*d* in fluid communication with the plurality of branch passages 130*a*, 130*b*, 130*c*, 130*d* of the manifold hub 118. The barrels 132*a*, 132*b*, 132*c*, 132*d* may extend integrally from the hub 118, such that the hub and barrels are unitary.

The manifold 112 further may include an actuator 137 disposed at the upper end 122 of the hub 118, and carried between the shroud 114 and the manifold hub 118. The actuator 137 may have a diameter larger than that of the manifold hub 118 and has an upper surface 139 accessible through the shroud 114 as discussed below. The actuator 137 may be in the form of a planar flange or pad as exemplified in the drawing figures, or may be ring-shaped, or of any other suitable shape. The manifold hub 118 and actuator 137 may be integral such that the manifold 112 may be a unitary component.

The shroud 114 includes a base wall 140, a circumferentially extending skirt 142 extending away from the base wall 140, and an outlet 144 in the skirt 142. The base wall 140 has an opening 145 therethrough to allow access to the manifold actuator 137. A rear portion of the shroud base wall 140 carries the opening 145 at a location diametrically opposite from the outlet 144.

The fitment 117 may be a collar and may include a base wall 170 having a base aperture 172, a circumferentially extending skirt 174 extending axially away from the base wall 170, and one or more detents 176 carried by the base wall 170 for engagement with the manifold barrels 132*a*, 132*b*, 132*c*, 132*d*. The fitment 117 also may include a plurality of ribs 178 extending between the base wall 170 and the skirt 174. In one embodiment, the fitment 117 may be axially trapped between the manifold 112 and the vessel. In another embodiment, the fitment 117 may be press-fit or interference fit to a vessel, for instance, to a closure of the vessel. For example, the ribs 178 may be tapered and may include one or more snap-fit features at upper ends thereof for snap-fit coupling to a vessel closure. The detents 176 may include circumferentially or tangentially spaced apart blade-like elements, as shown, or bumps, or a groove, or any other structure suitable to retain the barrels against relative circumferential movement. In other embodiments, the detent(s) 176 may be carried by or part of a pressurized vessel to which the discharge modifier 110 is coupled.

In assembly, the fitment 117 is located against an upper end of a pressurized vessel (not shown), and then the manifold 112 is lowered against the fitment 117. In doing so, one of the barrels 132*a*, 132*b*, 132*c*, 132*d* is circumferentially located with respect to the detent(s) 176, and an axially closed valve stem (not shown) of the pressurized vessel is inserted into the main passage 128 of the manifold 112 wherein a side outlet port (not shown) of the valve stem is circumferentially aligned with one of the branch passages 130*a*, 130*b*, 130*c*, 130*d*. Then the shroud 114 is lowered against the fitment 117 and around the manifold 112 such that a portion of the manifold actuator 137 protrudes out of the shroud opening 145 or is otherwise accessible therethrough. The shroud 114 may be coupled to the fitment 117, for instance, via cooperating diameters, which may be interference fit together, snap-fit together, threaded together via helical threads or bayonet features or the like, adhered together via solvent or glue or any other material suitable for adhering the shroud 114 and the fitment 117, welded together via sonic welding or any other welding suitable for the shroud and fitment materials, and/or coupled to one another in any other suitable manner.

In use, a user grasps the pressurized vessel with the user's hand and depresses an accessible portion of the manifold actuator 137 with one or more fingers of the user's hand to discharge fluid under pressure out of the pressurized vessel, into the valve stem, out of the side outlet port of the valve stem, through the first one of the plurality of branch passages 130*a*, 130*b*, 130*c*, 130*d* and through the outlet 144 of the shroud 114, out of the discharge modifier 110. To selectively arrange the discharge modifier 110 from a first arrangement to a second arrangement, the discharge modifier 110 need not be disassembled or removed from the pressurized vessel. Rather, the user may grasp the pressurized vessel with one hand, and use one or more fingers from the user's other hand to rotate the manifold 112 to circumferentially align the side outlet port of the valve stem with a second one of the plurality of branch passages 130*a*, 130*b*, 130*c*, 130*d* and circumferentially align a second one of the barrels with the fitment detent(s) 176. Accordingly, the actuator 137 is depressible for spray actuation and rotatable for selectively arranging spray characteristics. Of course, the manifold actuator 137 may include any suitable indicia to help the user orient the discharge modifier 110 and/or any suitable ergonomic features like finger indents, knurling, or the like to facilitate rotating of the actuator 137.

In general, the components of the discharge modifiers can be manufactured according to any suitable techniques to those skilled in the art, including molding, machining, stamping, additive manufacturing, and/or the like. Also, the discharge modifiers can be assembled according to any suitable techniques. Likewise, any suitable materials can be used in making the components, such as metals, composites, polymeric materials, and the like.

As used in this patent application, the terminology "for example," "for instance," "like," "such as," "comprising," "having," "including," and the like, when used with a listing of one or more elements, is open-ended, meaning that the listing does not exclude additional elements. Likewise, when preceding an element, the articles "a," "an," "the," and "said" mean that there are one or more of the elements. Moreover, directional words such as front, rear, top, bottom, upper, lower, radial, circumferential, axial, lateral, longitudinal, vertical, horizontal, transverse, and/or the like are employed by way of example and not limitation. As used herein, the term "may" is an expedient merely to indicate optionality, for instance, of an element, feature, or other thing, and cannot be reasonably construed as rendering indefinite any disclosure herein. Other terms are to be interpreted and construed in the broadest reasonable manner in accordance with their ordinary and customary meaning in the art, unless the terms are used in a context that requires a different interpretation.

Finally, the present disclosure is not a definitive presentation of an invention claimed in this patent application, but is merely a presentation of examples of illustrative embodiments of the claimed invention. More specifically, the present disclosure sets forth one or more examples that are not limitations on the scope of the claimed invention or on terminology used in the accompanying claims, except where terminology is expressly defined herein. And although the present disclosure sets forth a limited number of examples, many other examples may exist now or are yet to be discovered and, thus, it is neither intended nor possible to disclose all possible manifestations of the claimed invention. In fact, various equivalents will become apparent to artisans of ordinary skill in view of the present disclosure and will fall within the spirit and broad scope of the accompanying claims. Features of various implementing embodiments may be combined to form further embodiments of the invention. Therefore, the claimed invention is not limited to the particular examples of illustrative embodiments disclosed herein but, instead, is defined by the accompanying claims.

The invention claimed is:

1. A pressuuized vessel and discharge modifier assembly, comprising:

a pressurized vessel, including:

a container;

a closure coupled to the container and carrying a valved outlet;

a fitment coupled to the closure of the pressurized vessel, and including:

a fitment base wall having a base aperture; and a circumferentially extending fitment skirt extending away from the fitment base wall;

a shroud coupled to the fitment, and including:

a shroud base wall having an opening;

a circumferentially extending shroud skirt extending away from the shroud base wall; and an outlet in the shroud skirt; and a manifold separate from the fitment and the shroud, located between the fitment base wall and the shroud base wall, and including:

an inlet;

a blind main passage in fluid communication with the inlet;

a plurality of barrels extending radially outwardly, and including a plurality of barrel passages in fluid communication with the blind main passage and the inlet; and an actuator having an upper surface accessible through the opening in the base wall of the shroud, wherein the actuator is depressible independently of the shroud for spray actuation and wherein the actuator is rotatable for selectively arranging spray characteristics.

2. The discharge modifier of claim 1, wherein the barrels are semi-cylindrical.

3. The discharge modifier of claim 1, wherein the actuator has a diameter larger than that of the hub.

4. The discharge modifier of claim 1, wherein the opening in the base wall of the shroud is carried at a rear portion of the shroud at a location diametrically opposite from the outlet of the shroud.

5. A discharge modifier for a pressurized vessel, comprising:

a shroud, including:

a base wall;

a circumferentially extending skirt extending away from the base wall; and an outlet in the skirt;

a manifold, including:

a hub, including:

an axially lower end, an axially upper end, a radially outer surface, an inlet at the lower end, a through main passage extending between the lower and upper ends, and a plurality of branch passages in fluid communication with, and extending transversely outwardly from, the main passage;

a plurality of barrels extending radially outwardly with respect to the manifold hub, and including a plurality of barrel passages in fluid communication with the plurality of branch passages of the manifold hub; and a distributor rotatably carried in the main passage of the hub of the manifold, and including:

a sealing barrel sealed to the main passage of the hub, and including a circumferentially continuous lower end and an upper end axially spaced from the lower end;

an inlet port at a distributor lower end that extends past the axially lower end of the hub of the manifold;

an outlet port extending transversely out of the sealing barrel at a location axially between the upper and lower ends and in fluid communication with the inlet port via a passage extending therebetween.

6. The discharge modifier of claim 5, further comprising an actuator stem coupled to the shroud.

7. The discharge modifier of claim 6, wherein the actuator stem includes a non-circular coupling.

8. The discharge modifier of claim 5, wherein the distributor also includes an integral hollow stem.

9. A pressurized sprayer, comprising:

a pressurized vessel including a container and a closure coupled to the container; and the discharge modifier of claim 5, further comprising an enlarged flange coupled to the hub and circumferentially fixed against rotation with respect to the pressurized vessel, wherein the discharge modifier is selectively arrangeable without disassembly of the discharge modifier and without removal of the discharge modifier from the pressurized vessel.

10. The pressurized sprayer of claim 9, wherein the discharge modifier is selectively arrangeable by rotating the shroud.

11. The discharge modifier of claim 5, wherein the manifold also includes an enlarged flange extending away from the axially lower end of the hub and configured to be coupled directly to the pressurized vessel.

12. The discharge modifier of claim 5, wherein the base wall of the shroud includes an inside surface having a hub and socket to cooperate with actuator stem of the distributor.

13. The discharge modifier of claim 5, further comprising seals carried on axial sides of the outlet port such that the outlet port is disposed axially between the seals.

14. The discharge modifier of claim 13, wherein the seals are seal rings.

15. The discharge modifier of claim 14, wherein the seal rings are O-rings separate from the barrel or seals integrally molded to the barrel.

16. The discharge modifier of claim 5, wherein the barrels have fixed ends at the manifold hub and are cantilevered to terminate in free ends.

17. The discharge modifier of claim 16, wherein the barrels are three in quantity and are circumferentially equidistantly spaced from one another.

18. A discharge modifier for a pressurized vessel, comprising:

a shroud, including:

a base wall having an opening;

a circumferentially extending skirt extending away from the base wall, and an outlet in the skirt; and a manifold, including:

a hub, including:

an axially lower end, an axially upper end, a radially outer surface, an inlet at the lower end, a blind main passage extending between the lower and upper ends, and a plurality of branch passages in fluid communication with, and extending transversely outwardly from, the main passage; and a plurality of barrels extending radially outwardly with respect to the manifold hub, and including a plurality of barrel passages in fluid communication with the plurality of branch passages of the manifold hub; and an actuator disposed at the axially upper end of the hub, and having an upper surface accessible through the opening in the base wall of the shroud, wherein the actuator is depressible for spray actuation and rotatable for selectively arranging spray characteristics, further comprising:

a fitment, including:

a base wall having a base aperture;

a circumferentially extending skirt extending axially away from the base wall; and one or more detents carried by the base wall for engagement with the barrels of the manifold hub.

19. A pressurized vessel and discharge modifier assembly, comprising:

a pressurized vessel, including:

a container; and a closure coupled to the container and carrying a valved outlet;

a fitment coupled to the pressurized vessel, and including:

a fitment base wall having a base aperture;

a circumferentially extending fitment skirt extending away from the fitment base wall; and one or more detents carried by the base wall;

a shroud coupled to the fitment, and including:

a shroud base wall having an opening; and a circumferentially extending shroud skirt extending away from the shroud base wall; and a manifold separate from the fitment and the shroud, located between the fitment base wall and the shroud base wall, and including:

an inlet;

a blind main passage in fluid communication with the inlet;

a plurality of barrels extending radially outwardly, and including a plurality of barrel passages in fluid communication with the blind main passage and the inlet; and an actuator having an upper surface accessible through the opening in the base wall of the shroud for spray actuation and wherein the actuator is rotatable for selectively arranging spray characteristics.

* * * * *